US005388719A

United States Patent [19]

Takasugi et al.

[11] Patent Number: 5,388,719

[45] Date of Patent: Feb. 14, 1995

[54] FITTING STRUCTURE OF PARTITION PLATES TO STRUCTURE

[75] Inventors: Masataka Takasugi; Ikuo Kataoka, both of Ohtsuki, Japan

[73] Assignee: Yamashou Sangyo Kabushiki Kaisha, Yamanashi, Japan

[21] Appl. No.: 171,675

[22] Filed: Dec. 22, 1993

[30] Foreign Application Priority Data

Sep. 29, 1993 [JP] Japan ..... 5-268335

[51] Int. Cl.[6] ..... B65D 1/24

[52] U.S. Cl. ..... 220/553; 220/528; 220/532; 220/544

[58] Field of Search ..... 220/528, 532, 533, 544, 220/553, 526, 540, 549

[56] References Cited

U.S. PATENT DOCUMENTS

| | | | |
|---|---|---|---|
| 1,668,179 | 5/1928 | Williams | 220/553 |
| 2,453,463 | 11/1948 | Sherman | 220/553 |
| 3,438,215 | 4/1969 | Frijunk | 220/553 |
| 3,570,702 | 3/1971 | Yamaoto | 220/553 |
| 3,645,415 | 2/1972 | Phelps | 220/553 |
| 4,308,953 | 1/1982 | Cohen | 220/533 |
| 4,469,295 | 9/1984 | Schuster | 220/553 |
| 4,628,827 | 12/1986 | Litten | 220/533 |
| 5,054,668 | 10/1991 | Ricchiuti | 220/528 |

*Primary Examiner*—Joseph Man-Fu Moy
*Attorney, Agent, or Firm*—Browdy & Neimark

[57] ABSTRACT

A fitting structure of partition plates to a structure is disclosed which is directed to providing a sufficient bonding strength to one of the surfaces of an end portion of the partition plates fitted to a groove and a sufficient water-stopping property to the other surface.

When the end portion of the partition plate is fitted to the groove, a very small space is defined between one of the side surfaces of the end portion and one of the side walls of the groove opposing the former, through a spacer, and a sealing material is set in a thin film form in this space. A large space is defined between the other side surface of the end portion and the other side wall of the groove opposing the former, through a thick spacer, and the sealing material is set in a thick form in this space.

2 Claims, 5 Drawing Sheets

FITTING STRUCTURE OF PARTITION PLATES TO STRUCTURE

BACKGROUND OF THE INVENTION

1. Field of the Invention

This invention relates to a fitting structure of partition plates to a structure.

2. Description of the Related Art

A sewage disposal tank is an example of the structures using a fitting structure of partition plates to a structure. To divide the inside of a tank body into a plurality of treatment chambers, the sewage disposal tank employs the construction wherein end portions of partition plates are fitted into, and bonded to, a groove formed along the inner periphery of the tank body through a sealing material.

In the sewage disposal tank described above as an example of the prior art, however, a normal treating function might be inhibited when untreated sewage in a treatment chamber of a pre-stage leaks from a fitting gap between a groove and partition plates and mixes with treated sewage in the treatment chamber of a post-stage, for example. To prevent such a problem, seal must be effected in such a manner as to satisfy two conditions, that is, sufficient bonding strength of the partition plates to the groove and sufficient water-stopping strength between them.

To secure the sufficient bonding strength, it is effective that the sealing material exists in the form of a thin film between the surfaces to be bonded, and to secure sufficient water-stopping strength, it is effective that the sealing material exists in the form of a thick film, on the contrary. To make positioning of the fitting positions of the partition plates to the groove easy, the groove and the end portions of the partition plates are generally finished into a tight fitting state and for this reason, the thin film of the sealing material is naturally interposed and the sufficient bonding strength can be secured. In contrast, since the thick film of the sealing material is not obtained, there remains the problem that the water-stopping function is low.

Accordingly, the structure described above is far from suitable as a partition plate fitting structure of a structure in which water leakage must not occur, such as the sewage disposal tank.

SUMMARY OF THE INVENTION

The present invention therefore aims at providing a partition plate fitting structure for the sewage disposal tank and various other structures analogous to the former which have both sufficient bonding strength and sufficient water-stopping function and in which water leakage, in particular, must never occur.

To accomplish the object described above, in a fitting structure of partition plates to a structure in which an end portion of each partition plate is fitted into a groove of the structure through a sealing material so as to bond both side surfaces of the end portion of the partition plate to groove walls opposing the side surfaces by the sealing material, the fitting structure according to the present invention employs the construction wherein a thin spacer is interposed between one of the side surfaces of the end portion of the partition plate and one of the side walls of the groove opposing this one side surface and the sealing material is set in a thin film form in a very small space defined between the one side surface of the end portion and the one side wall of the groove on the side of the one side surface, a thick spacer is interposed, on the other hand, between the other side surface of the end portion of the partition plate and the other Side wall of the groove opposing the other side surface, and the sealing material is set in a thick form in a sufficiently large space defined between the other side surface of the end portion and the other side wall of the groove on the side of the other side surface.

DESCRIPTION OF THE PREFERRED EMBODIMENTS

An embodiment of the present invention will be described about a sewage disposal tank as an example of the structure.

Figure 1:
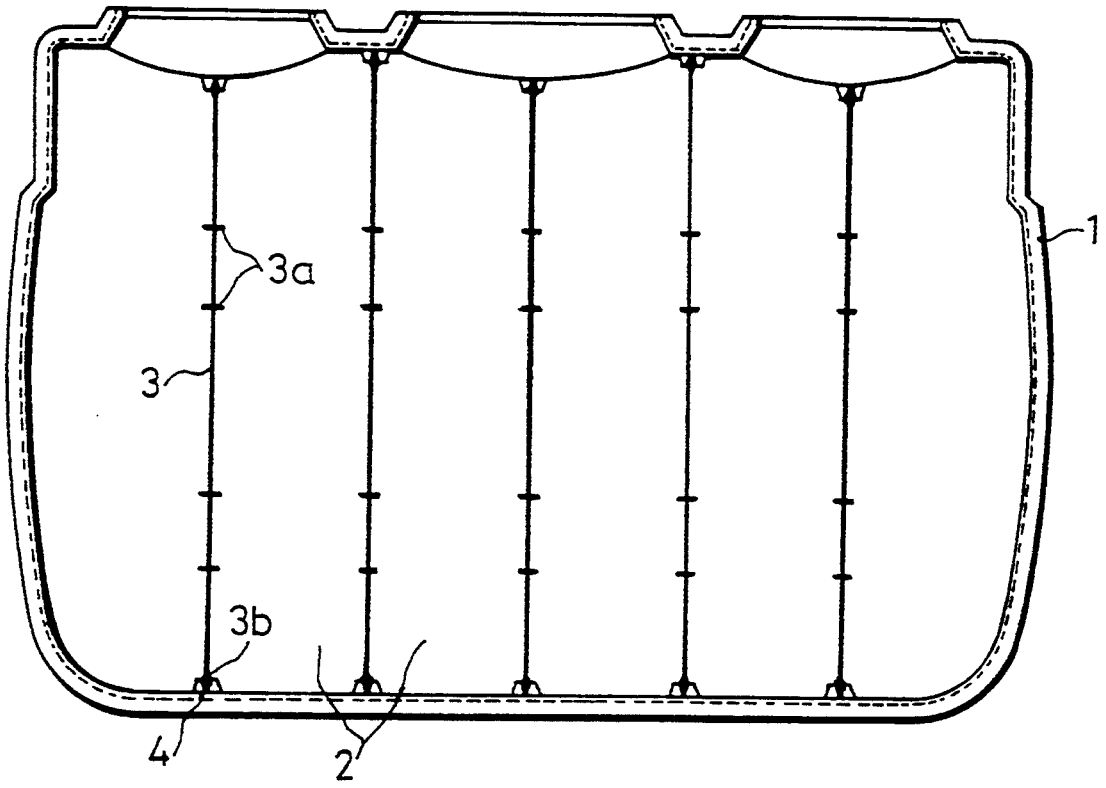
FIG. 1 is a longitudinal sectional view of a sewage disposal tank.

Referring initially to FIG. 1, reference numeral 1 denotes a tank body consisting of a synthetic resin molded article which constitutes the sewage disposal tank. The inside of this tank body 1 is partitioned into a plurality sewage treatment chambers 2 communicating with one another from a front inflow side to a rear outflow side by a plurality of partition plates 3 consisting of a synthetic resin molded article.

Figure 2:
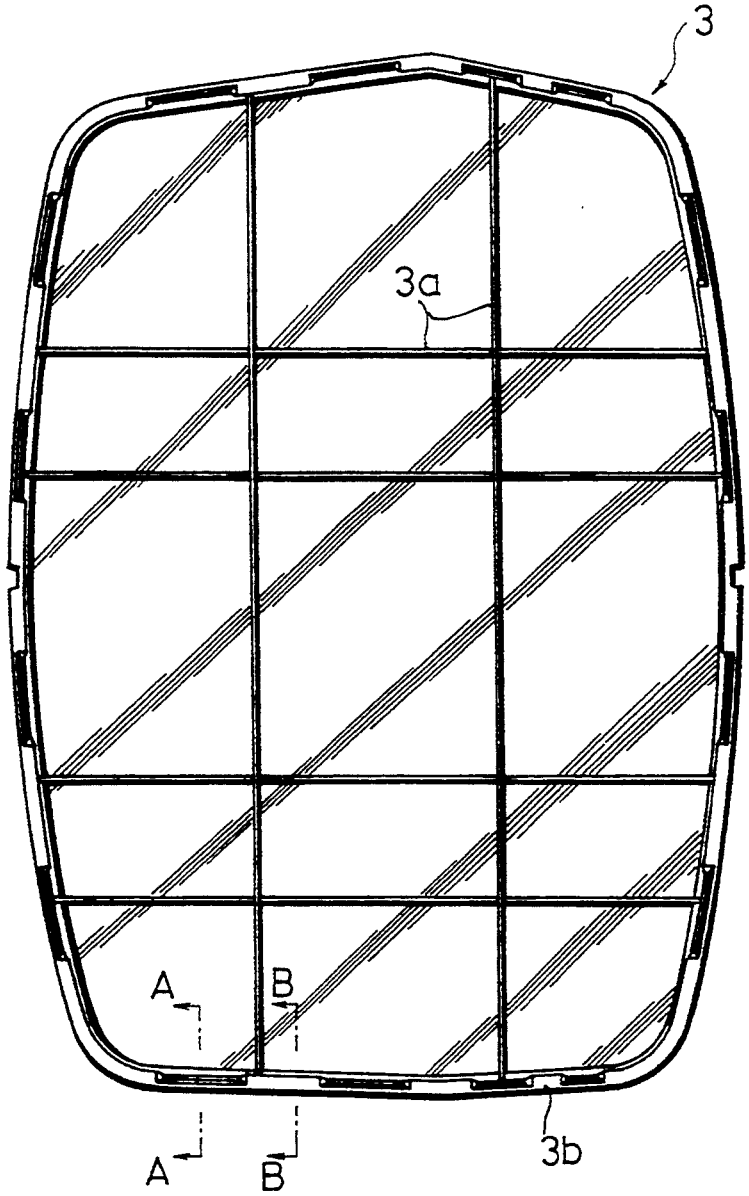
FIG. 2 is a front view of a partition plate.

As shown in FIG. 2, each partition plate 3 is equipped with a reinforcing rib 3*a*, has a front surface shape adapting to the longitudinal section of the tank body 1, and has an outer peripheral edge which constitutes a fitting end portion 3*b* to be fitted into a groove 4 formed along the inner peripheral surface of the tank body 1.

Figure 3:
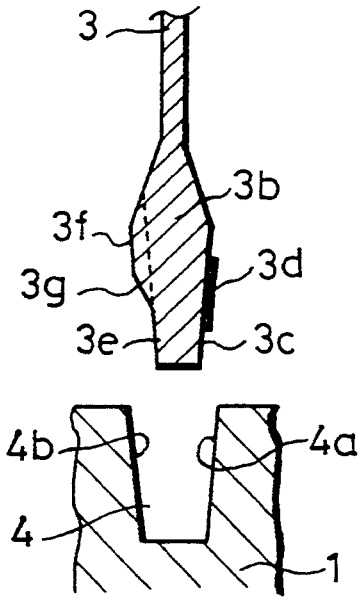
FIG. 3 is a sectional view showing the relationship between a groove and an end portion of the partition plate along a line A—A.
Figure 4:
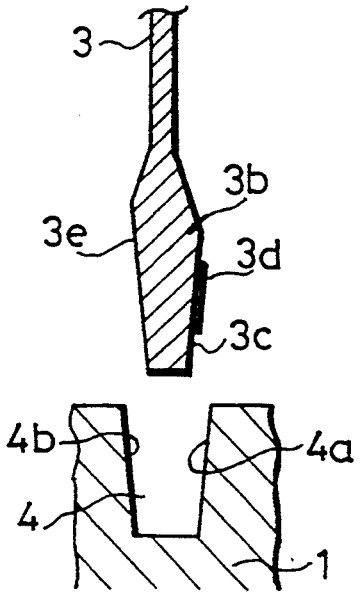
FIG. 4 is a sectional view showing the relationship between the groove and the end portion of the partition plate along a line B—B.
Figure 5:
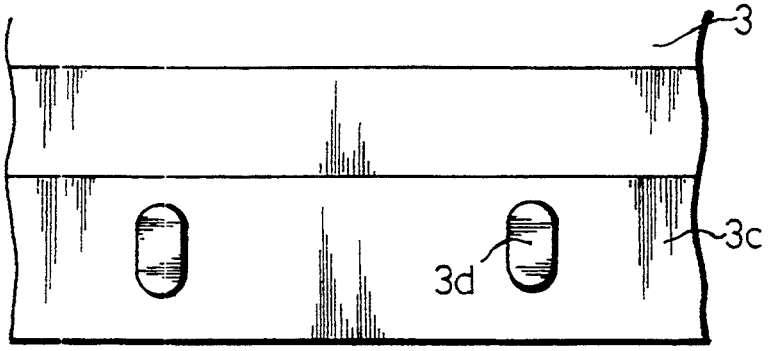
FIG. 5 is a rear view of a part of the partition plate.
Figure 6:
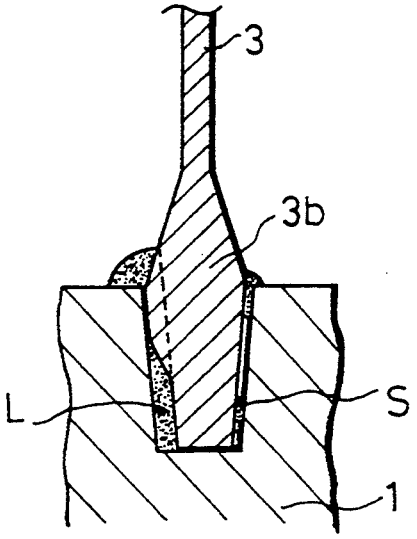
FIG. 6 is a sectional view showing the state where the end portions of the partition plate are fitted into the groove.

First, the groove 4 has a shape which allows pattern-draw at the time of molding as shown in FIGS. 3 and 4, that is, a sectional shape such that the inlet side opening to the inner peripheral surface of the tank body 1 is wide but the width progressively decreases from the inlet side to ward the bottom of the groove in a taper shape.

On the other hand, one (3*c*) of the side surfaces of the end portion 3*b* of the partition plate 3 to be fitted into the groove 4 is shaped into a slope which is in parallel with one (4*a*) of the side walls of the groove 4 opposing this side surface 3*c* when the partition plate 3 is fitted, and thin spacers 3*d* (about 0.5 mm-thick) are integrally formed with a predetermined gap at positions, where they can be buried within the range of depth of the groove 4, on the slope, that is, the side surface 3*c* described above.

On the other hand, the full periphery of the other side surface 3*e* of the end portion 3*b* of the partition plate 3 is shaped into the slope which is in parallel with the other side wall 4*b* of the groove in the same way as the side surface 3*c*, and thick spacers 3*f* (about 2 mm-thick), which come into contact with the portion of the side wall 4b of the groove 4 which is closer to the inlet, are so formed integrally as to protrude with a predetermined gap between them.

The basic slope and the thick spacers 3f constituting the other side surface 3e guide a sealing material inside the groove 4 towards the inlet side of the groove when the partition plate is fitted into the groove 4, and communicate with each other through a taper-like step 3g for air vent.

The end portion 3b of the partition plate 3 is fitted into the groove 4 from the inlet side towards the groove bottom. When this fitting operation is made, the thin spacers 3d on the side surface 3c of the end portion 3b strike the side wall 4a of the groove 4 while the thick spacers 3f on the other side surface 3e of the end portion 3b strike the wall surface of the other side wall 4b of the groove 4 near the inlet. As a result, the end portion 3b is fitted into the groove 4 while being positioned.

Due to the fitting operation described above, a very small space S (0.5 mm) restricted by the thin spacers 3d is naturally formed between the side surface 3c of the end portion 3b and the side wall 4a of the groove 4 opposing the former, and the sealing material which is charged into the groove in a suitable quantity beforehand turns to a thin film in the space S due to the pushing pressure by the fitting and a part of this sealing material swells out to the inlet portion of the groove 4 and bonds the opposed surfaces with each other on this side.

A relatively large space L (2 mm) restricted by the thick spacers 3f is defined between the other side surface 3e of the end portion 3b and the other side wall 4b of the groove 4 opposing the former, and the sealing material is interposed in a thick form into this space. Further, a part of this sealing material swells out to the inlet portion of the groove as shown in the drawing, and bonds and seals water-tight the opposed surfaces with each other in a thick layer effective for water-stopping.

When the sealing material is charged into the space L, the taper-like step 3g satisfactorily guides it towards the inlet side of the groove and at the same time, purges air inside the groove, which will otherwise lower water-stopping strength, towards the inlet side.

Though the spacers 3d and 3f are integrally formed with the partition plate 3 in the embodiment described above, they may be separate members, and the same function can be expected of in this case, too.

This embodiment deals with the fitting structure of the partition plates of the sewage disposal tank, or in other words, the structure for fitting the partition plates consisting of a single plate and fittable to the longitudinal sectional shape of the disposal tank. Accordingly, the tank body 1 is longitudinally split into longitudinal split tanks 1a and 1b on a vertical line passing through the diameter of a manhole, and the longitudinal split tanks 1a and 1b are butt-joined in such a manner as to sandwich the partition plate 3 between them and to clamp its peripheral edge so that the entire periphery of the end portion 3b of the partition plate can be fitted into the grooves of the tank bodies 1a and 1b. Another reason why the purification tank is split into the longitudinal tanks 1a and 1b is as follows.

The capacities of various disposal tanks having mutually different treating capacities such as tanks for five-people, six-people, seven-people, etc, are set in advance for each tank at the stage of design of the tank. Therefore, a variety of molding dies must be prepared in conformity with a variety of tanks.

Because the production cost of a molding die is generally as high as several hundred million yen, it will be extremely uneconomical to prepare many kinds of dies. The number and kind of molding dies can be limited to minimum and the production cost of the dies can be drastically saved if the treating capacity of the disposal tanks is set by selecting and combining longitudinal split tanks having mutually different capacities.

Figure 7:
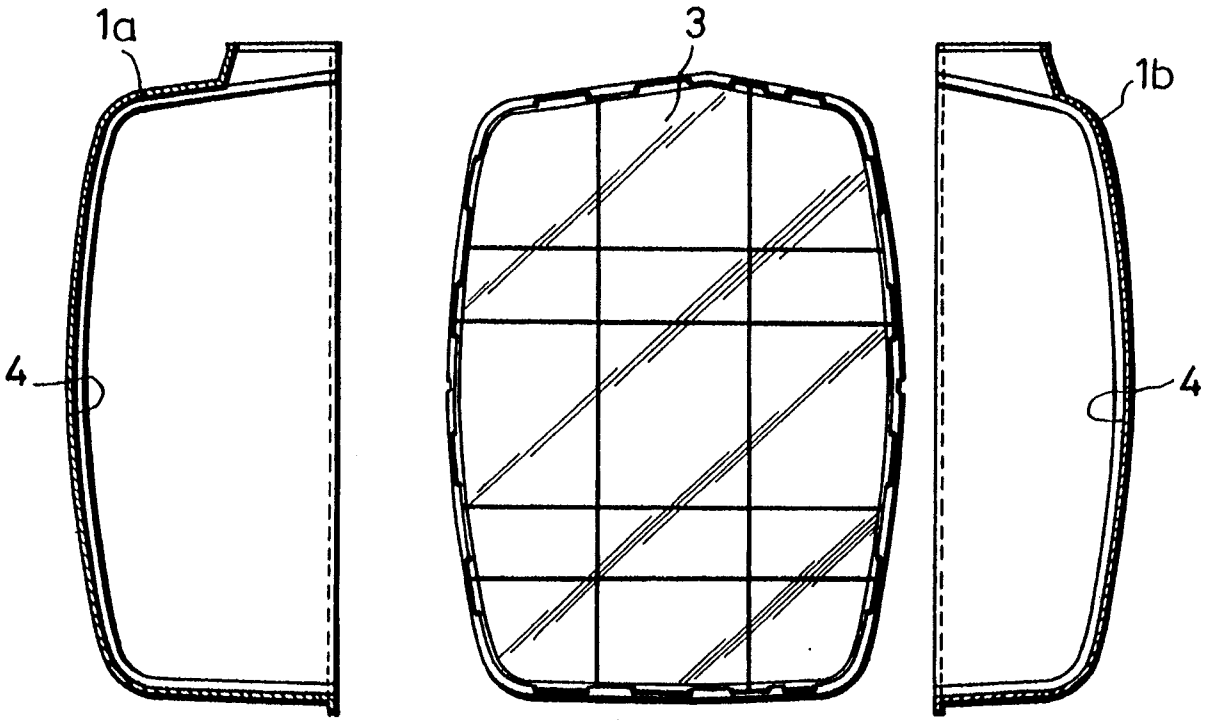
FIG. 7 is an explanatory view showing the state where the partition plate is being fitted into the sewage disposal tank.

In a definite embodiment for this purpose, a first longitudinal split tank 1a having a large capacity and a second longitudinal split tank 1b having a small capacity are prepared as shown in FIG. 7. When the second longitudinal split tanks 1b are combined with each other, a five-people tank can be prepared and when the first and second longitudinal split tanks 1a and 1b are combined, a six-people tank can be obtained. Further, when the first longitudinal split tanks are combined, a seven-people tank can be obtained.

In this case, the partition plates 3 fitted into the tank body 1 are arranged in such a manner that the left side of the partition plate 3, that is, the thick side of the sealing material, faces the inflow side of the tank body and the thin side of the sealing material on the right side faces the outlet side. In this way, the water-stopping strength and bonding strength of the end portion 3b of the partition plate 3 to the groove 4 can be maintained with good balance.

Effect of the Invention

As described above in detail, the present invention provides the following effects.

(a) When the end portions of the partition plate are fitted into the groove of the structure, the spacers abut against both side surfaces of the end portion and both side walls of the groove opposing the side surfaces. Therefore, fitting positioning of the end portions to the groove can be made.

(b) One of the spacers for effecting fitting and positioning operations described above has a small thickness, is sandwiched between one of the side surfaces of the end portion of the partition plate and one of the side walls of the groove opposing the former, and defines a very small gap between them. The other spacer has a large thickness, is sandwiched between the other side surface of the end portion and the other side wall of the groove opposing the former, and defines the large space between them. Therefore, the sealing material exists in a thin film form in the very small space and is interposed in a thick layer form in the large space. Accordingly, bonding strength can be secured by the thin film of the sealing material on one of the side surfaces of the end portion of the partition plate, while the water-stopping strength can be secured on the other surface of the end portion of the partition plate. Accordingly, excellent effects can be obtained when this structure is applied to the sewage disposal tank which must have high bonding strength and must be free from water leakage or to the fitting structures of the partition plates to various structures analogous to the sewage disposal tank.

What is claimed is:

1. A fitting structure of partition plates to a structure in which an end portion of each of said partition plates is fitted into a groove of said structure through a sealing material so as to bond both side surfaces of said end portion of said partition plate to groove walls opposing the side surfaces by said sealing material, characterized in that a thin spacer is interposed between one of the side surfaces of said end portion of said partition plate and one of the side walls of said groove opposing said one side surface and said sealing material is set in a thin film form in a very small space defined between said one side surface of said end portion and said one side wall of said groove on the side of said one side surface, a thick spacer is interposed, on the other hand, between the other side surface of said end portion of said partition plate and the other side wall of said groove opposing said other side surface, and said sealing material is set in a thick form in a sufficiently large space defined between said other side surface of said end portion and said other side wall of said groove on the side of said other side surface.

2. A fitting structure of partition plates to a structure according to claim 1, wherein said structure is a sewage disposal tank, said disposal tank comprises first and second longitudinal split tanks formed by splitting said disposal tank on a vertical split plane which passes through a diameter of a manhole and on which said first and second split tanks butt and coincide with each other, and said first and second longitudinal split tanks are butted to each other from the right and left in such a manner as to interpose said partition plates between them so that said end portions of said partition plates are fitted into said groove disposed on the inner surface of said longitudinal split tanks through said sealing material.

* * * * *